US007530126B2

(12) United States Patent
Thompson et al.

(10) Patent No.: US 7,530,126 B2
(45) Date of Patent: May 12, 2009

(54) FIREFIGHTER AND HAZMAT RESCUE BOARD

(76) Inventors: Justin W. Thompson, P.O. Box 1243, Rohnert Park, CA (US) 94927; Troy A. Moore, P.O. Box 1243, Rohnert Park, CA (US) 94927

( * ) Notice: Subject to any disclaimer, the term of this patent is extended or adjusted under 35 U.S.C. 154(b) by 0 days.

(21) Appl. No.: 11/968,611

(22) Filed: Jan. 2, 2008

(65) Prior Publication Data

US 2008/0155751 A1 Jul. 3, 2008

Related U.S. Application Data

(60) Provisional application No. 60/883,113, filed on Jan. 2, 2007.

(51) Int. Cl.
*A61G 1/00* (2006.01)

(52) U.S. Cl. ..... 5/625; 5/626; 128/870

(58) Field of Classification Search ..... 5/625–629; 128/870

See application file for complete search history.

(56) References Cited

U.S. PATENT DOCUMENTS 5,274,864 A 1/1994 Morgan
5,414,883 A 5/1995 Fangrow, Jr.
5,473,784 A 12/1995 Nixon et al.
5,560,059 A 10/1996 McQueen
5,568,662 A 10/1996 Gougelet
5,765,243 A 6/1998 Duncan et al.
6,065,165 A 5/2000 Delk et al.
6,641,446 B1 11/2003 Bentley
6,954,952 B1 10/2005 Kroupa
7,082,632 B2 8/2006 Hood

*Primary Examiner*—Michael Trettel
(74) *Attorney, Agent, or Firm*—Craig M. Stainbrook; Stainbrook & Stainbrook, LLP

(57) ABSTRACT

A firefighter/hazmat rescue board for transporting injured workers wearing an open circuit rescue firefighter self-contained breathing apparatus (hereinafter, "SCBA"). The inventive apparatus includes a substantially rectangular plank with an upper deck, a lower surface, an upper/head portion with hand holds, a lower/mid-body portion with a hand hold, a right side, a left side, and an SCBA opening disposed through the plank. The SCBA opening is shaped and sized to be readily and easily disposed around a standard-sized 30-60 minute SCBA air cylinder and valve during a rescue operation. A harness system is provided for strapping the injured worker to the plank.

18 Claims, 5 Drawing Sheets

FIREFIGHTER AND HAZMAT RESCUE BOARD

CROSS REFERENCES TO RELATED APPLICATIONS

The present application claims the benefit of the filing date of U.S. Provisional Patent Application Ser. No. 60/883,113, filed Jan. 2, 2007 (Jan. 2, 2007).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to rescue worker equipment and apparatus, and more particularly to apparatus for rapidly placing, securing, and transporting an injured firefighter and/or hazmat worker who is wearing a self-contained breathing apparatus.

2. Discussion of Related Art Including Information Disclosed Under 37 CFR §§1.97, 1.98

U.S. Pat. No. 7,082,632, to Hood, discloses a collapsible and extendable, traction-providing portable stretcher and body splint type rescue device. It includes a top, middle, and optional bottom portion, all formed from radiolucent material. The top portion includes a head gear slidably adjustable that provide cervical traction. Padding on the top and middle portions is removable. Restraining devices are provided to immobilize a victim on the rescue device.

U.S. Pat. No. 6,641,446, to Bentley, teaches a rescue sled for picking up and transporting victims of water or ice accidents. It includes a body of multipiece molded construction with a polyethylene outer skin filled with plastic foam for buoyancy. The sled is generally rectangular with a deck, a rounded prow-shaped front end, straight sides, and a slightly rounded rear end. The sled includes a plurality of holes which can receive a tow rope or ropes. The sides include a plurality of rectangular holes for straps which can be used to secure a person to the sled for transport, and it further includes hand holds in the deck.

U.S. Pat. No. 5,568,662, to Gougelet, shows a spinal and cervical immobilization apparatus combining a fiber-reinforced, resin transfer molded, spinal immobilization board having rows of slots at one end with head and neck support brackets fitting into the slots. The board has rounded and upturned corners, molded grip holes with finger indentations, and beveled indentations for the head and torso of a patient into which fit padding.

U.S. Pat. No. 5,274,864, to Morgan, describes a composite litter board made from two rigid boards releasably secured to each other by two rigid partial sleeves with C-shaped cross sections that have narrow openings. The board is thus collapsible for easy storage and transport.

U.S. Pat. No. 5,765,243, to Duncan, et al, teaches a scoop-type patient carrier having separable halves to facilitate placement of the halves beneath a patient, and configured to enable radiographic examination. The halves are split along at the midline or longitudinal centerline of the assembled carrier. This arrangement results in the absence of any joint or line of separation in the upper and lower sections that are aligned with the carrier centerline, and which support the head and feet. This enables the carrier halves to be joined or separated without any accompanying movement of the head and feet of the patient.

U.S. Pat. No. 6,065,165, to Delk, et al, teaches a patient transport apparatus for engaging the front of a body of a patient comprising a unitary support board having a first aperture for the face of the patient, a second aperture to expose the abdomen of the patient, and a third aperture to expose the groan of the patient.

U.S. Pat. No. 6,954,952, to Kroupa, shows a rigid, X-ray translucent backboard for transporting an injured person.

U.S. Pat. No. 5,560,059, to McQueen, describes a transport stretcher comprising a conventional board modified by forming valve stem bores and a pair of depressions for receiving inflatable supports.

U.S. Pat. No. 5,473,784, to Nixon, et al, teaches a body board having an outer plastic shell having a hollow interior. The underside of the shell includes runners which space handholds about the periphery of the body board. The hollow interior includes a fiberglass reinforcement structure. The density of the board is adapted to ensure that x-rays passed through the x-ray region of the body board are absorbed substantially uniformly, without producing any lines of high density on x-ray film.

U.S. Pat. No. 5,414,883, to Fangrow, Jr., discloses a rescue board made of a hollow plastic shell with supporting beams extending substantially its length. The beams are encapsulated within hollow ribs extending along the bottom of the shell with several spacers and plugs to help position the beams. The beams provide rigidity to the backboard in the primary load bearing direction.

The foregoing patents reflect the current state of the art of which the present inventor is aware. Reference to, and discussion of, these patents is intended to aid in discharging Applicants' acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein. In particular, none of the prior art references show a device suitable for use in dragging an injured worker who is wearing a self-contained breathing apparatus.

BRIEF SUMMARY OF THE INVENTION

The present invention is a firefighter/hazmat rescue board specially adapted for use in transporting fellow rescue workers who may be non-ambulatory or otherwise injured, and who must be placed on the rescue board and transported while wearing an open circuit firefighter self-contained breathing apparatus (hereinafter, "SCBA"). The inventive apparatus includes a substantially rectangular plank with an upper deck, a lower surface, an upper/head portion having one or more hand holds, a lower/mid-body portion, a right side, a left side, and an SCBA opening disposed through said plank and extending from said upper/head portion to said lower/mid-body portion. The SCBA opening is shaped and sized to be readily and easily disposed around a standard-sized 30-60 minute SCBA air cylinder and valve during a rescue operation. To facilitate ease in fitting into confined spaces and to assist in cradling an incapacitated worker, the upper deck is concave from the upper/head portion to the lower/mid-body portion. A harness system is also provided. This includes several harness slots disposed in the plank, preferably including a pair of upper harness attachment slots, two side harness attachment slots, and a lower harness attachment slot. Fabric straps with fastener and closure apparatus are also provided.

The bottom side and lower surface of the plank includes skid fins to provide a low friction skidding surface. They may be installed in a fin box for easy removal and replacement

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
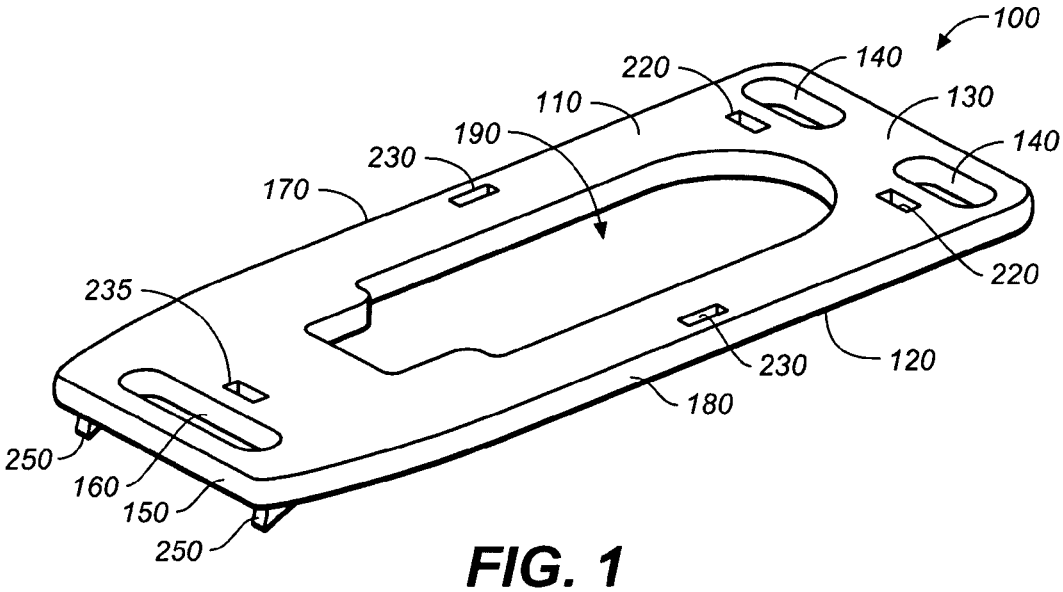
FIG. 1 is an upper perspective view of the firefighter and hazmat rescue board of the present invention.
Figure 2:
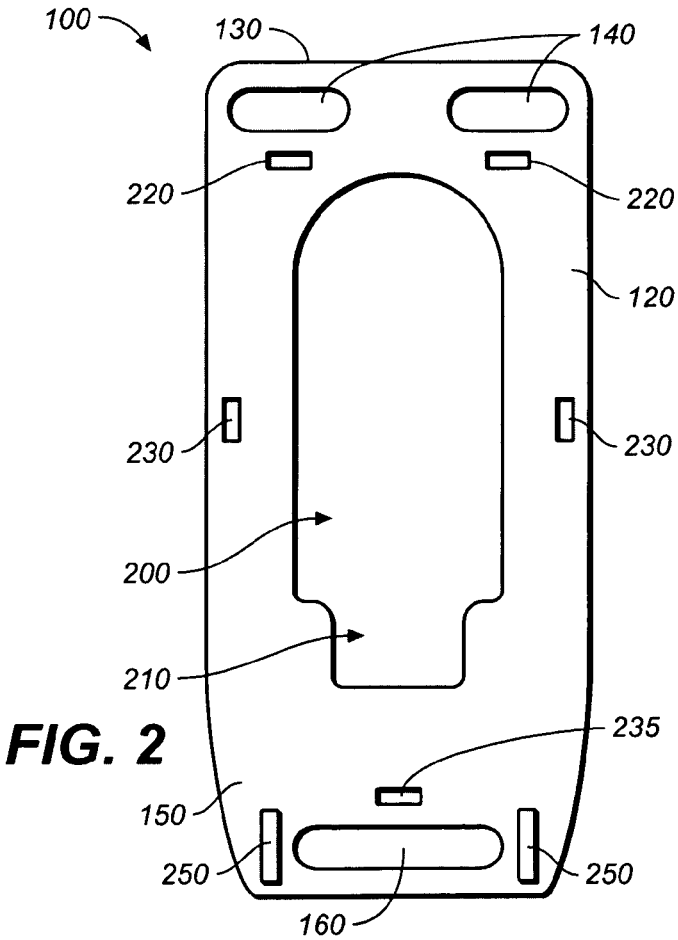
FIG. 2 is a top plan view of the board of FIG. 1.
Figure 3:
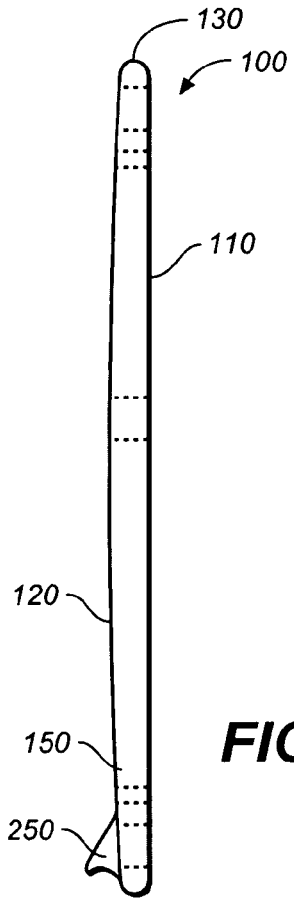
FIG. 3 is an elevational side view of the rescue board of FIGS. 1 and 2.
Figure 1A:
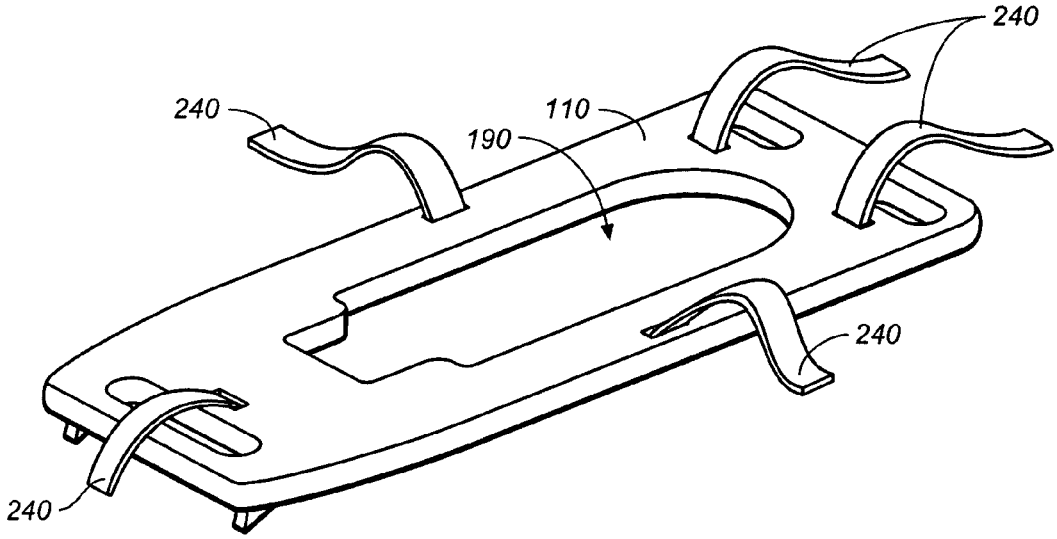
FIG. 1A is the same view showing the rescue board having a plurality of straps comprising a harness system for securing a victim on the rescue board.
Figure 2A:
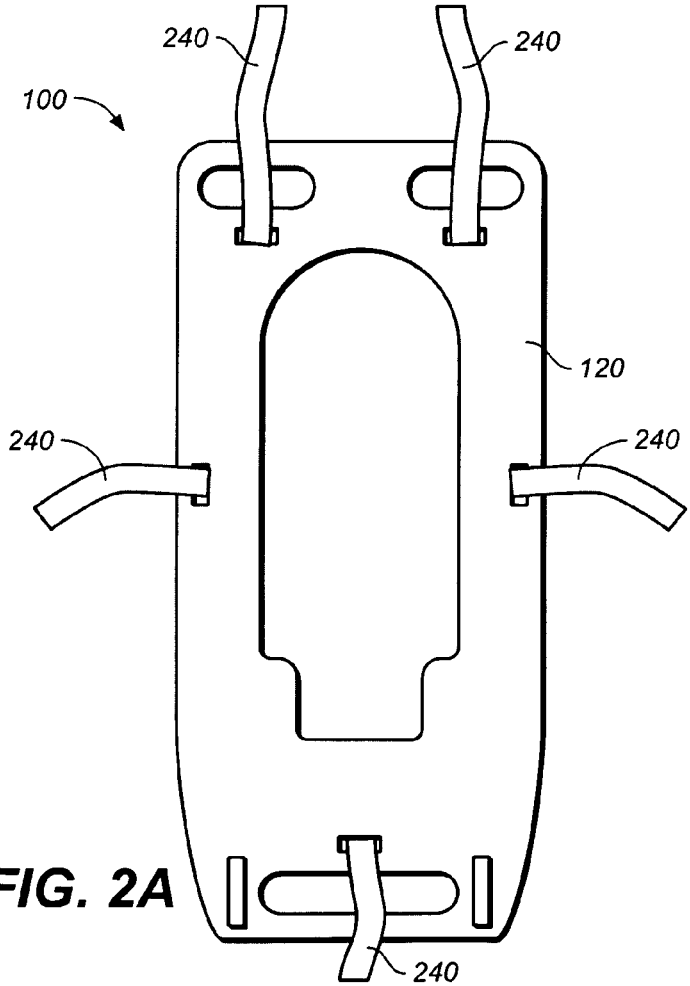
FIG. 2A is a top plan view showing the rescue board, including harness system, of FIG. 1A.
Figure 3A:
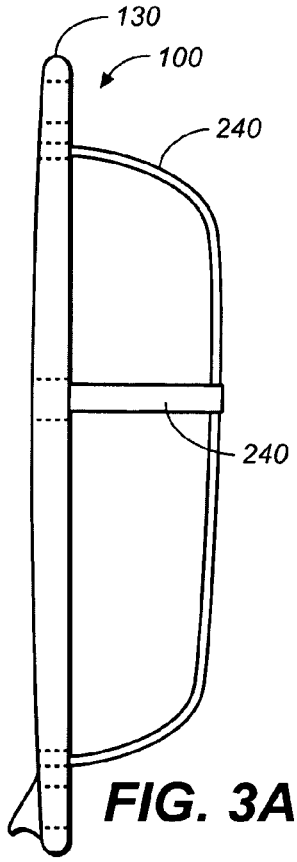
FIG. 3A is an elevational side view of the rescue board of FIGS. 1A and 2A, showing the rescue board with the harness system included.

Referring first to FIGS. 1 through 3, wherein like reference numerals refer to like components in the various views, there is illustrated therein a new and improved firefighter and hazmat rescue board, generally denominated 100 herein. The inventive apparatus is specifically designed to assist in the process of removing or rescuing a downed firefighter, hazmat worker, or other rescue worker, who may be wearing an SCBA. The board is preferably fabricated from high density polyethylene, though any of a number of suitably strong and lightweight materials may be used.

The rescue board comprises a generally rectangular polymeric plank having an upper deck 110, a lower surface 120, an upper/head portion 130 having one or more hand holds 140, a lower/mid-body portion 150 having at least one hand hold 160, a right side 170, and a left side 180. Preferably the corners at the head portion and lower/mid-body portion are slightly rounded. Additionally, preferably the board includes a slight curvature from top to bottom, such that the upper deck is provided with a slight concavity from the upper/head portion to the lower/mid-body portion. It may also be curved and slightly concave from right to left. The desired curvature is slight and is included only to assist in gently cradling a disabled victim.

The board further includes an SCBA opening 190, extending from the upper/head portion to the lower/mid-body portion. The opening is shaped and sized to be readily and easily disposed around a standard-sized 30-60 minute SCBA air cylinder and main valve during a rescue operation. Because tanks in open circuit firefighter breathing sets generally include tanks ranging between 5 and 7 inches (approximately 13-18 cm) in diameter, and 18 to 22 inches (approximately 46-56 cm) in length, the SCBA opening in the plank will be larger by a considerable margin so that the plank can be rapidly and effective placed over the tank and main valve while not compromising the structural integrity of the board. Accordingly, the opening will be at least 18 inches in a length dimension and at least 5 inches in a width dimension. However, it will be understood that as technological improvements makes the use of smaller tanks possible, the SCBA opening can be adapted for the optimal fit.

Still referring to FIGS. 1-3, as can be readily seen, the SCBA opening 190 includes a tank portion 200 and a valve portion 210, the configuration essentially comprising an outline of the SCBA tank configuration. It will be appreciated, however, that the SCBA opening need not have any reduction in size defining a valve portion, but instead could have a generally rectangular shape sized simply to fit easily over the SCBA tank and valve.

The preferred dimensions of the plank are as follows: 1.5 inches (~4 cm) in thickness; 18 inches (~46 cm) in width; and 40 inches (~120 cm) in length. Suitable size ranges are 0.5 to 2 inches in thickness, 15 and 25 inches in width, and 30 to 50 inches in length. Again, it will be appreciated that such dimensions are somewhat arbitrary, though the preferred dimensions have been found to be effective for loading and dragging an adult male of typical size and weight. Furthermore, a full sized board may be employed for water rescues, wherein the board length is considerably greater than the dimensions recited above. In the case of such a water rescue board, the board length may extend up to seven feet to accommodate and fully support most persons of typical height.

A harness system is provided and comprises upper harness attachment slots 220, side harness attachment slots 230, and a lower harness attachment slot 235. Straps 240 or webbing are provided and include fastening and closure apparatus, such as buckles, hook and loop material, or the like. The harness system may be provided with a foldable strap or web configuration with rapid tear-apart apparatus for rapid deployment in the field.

Proximate the lower/mid-body portion, at least one, and preferably two, skid fins or drag skegs 250 are disposed for facilitating dragging the board along a floor or ground surface. The skid fins minimize friction by providing relatively narrow ground-engaging surfaces at the tips of the skid fins. The fins may be shaped in the manner of typical curved surfboard fins, though semicircular and many other shapes may be employed. Additionally, the skid fins may be attached in a fin box and so made to be removable and replaceable, such that fins of many sizes and shapes can be selected and employed when the anticipated use calls for skidding across a certain kind of surface. Skid fins may be omitted in the case of a full sized water rescue board.

Figure 4:
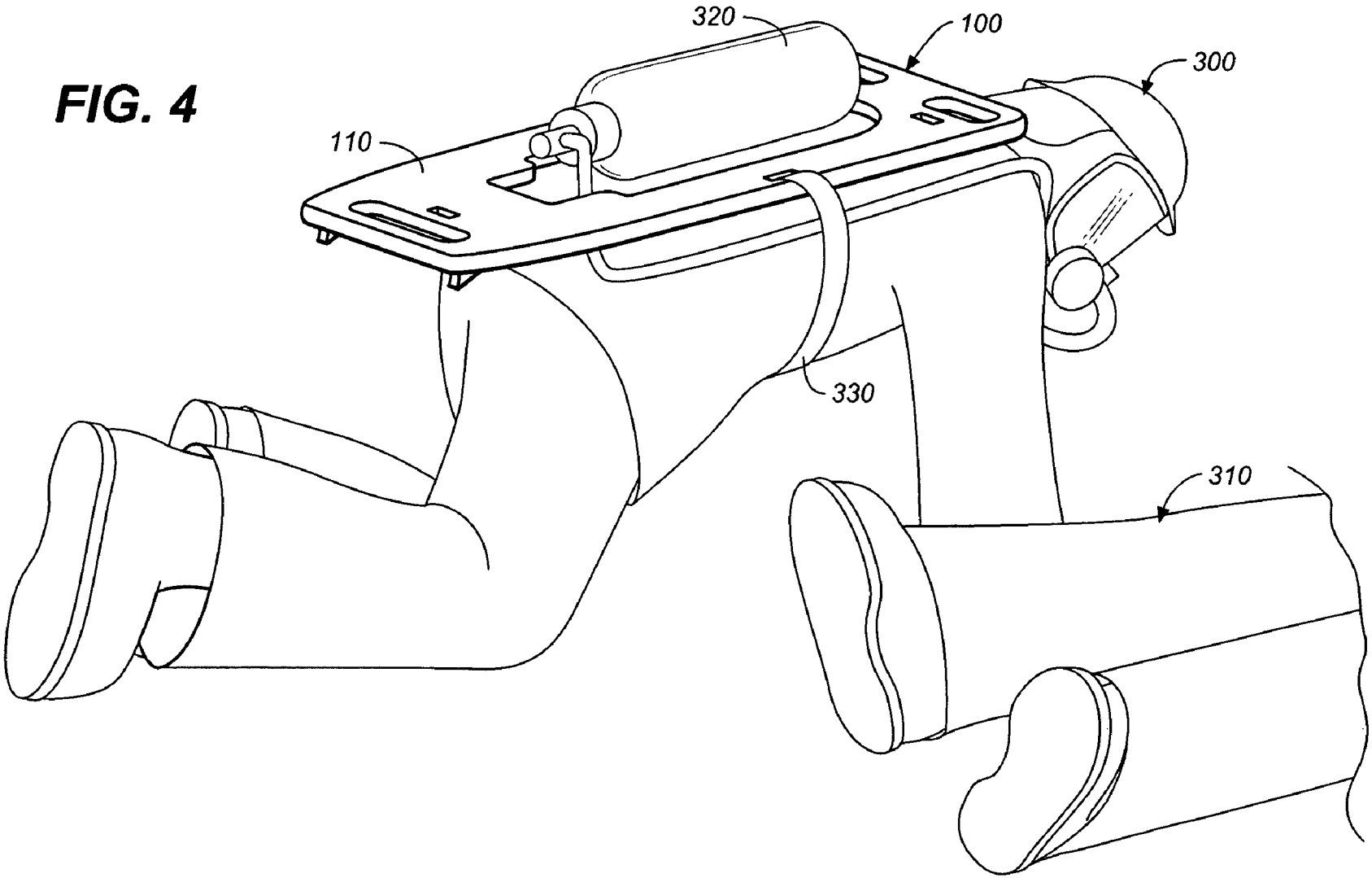
FIG. 4 is a perspective view showing the rescue board secured to a non-injured rescue worker for carrying the rescue board to an immobile victim.
Figure 5:
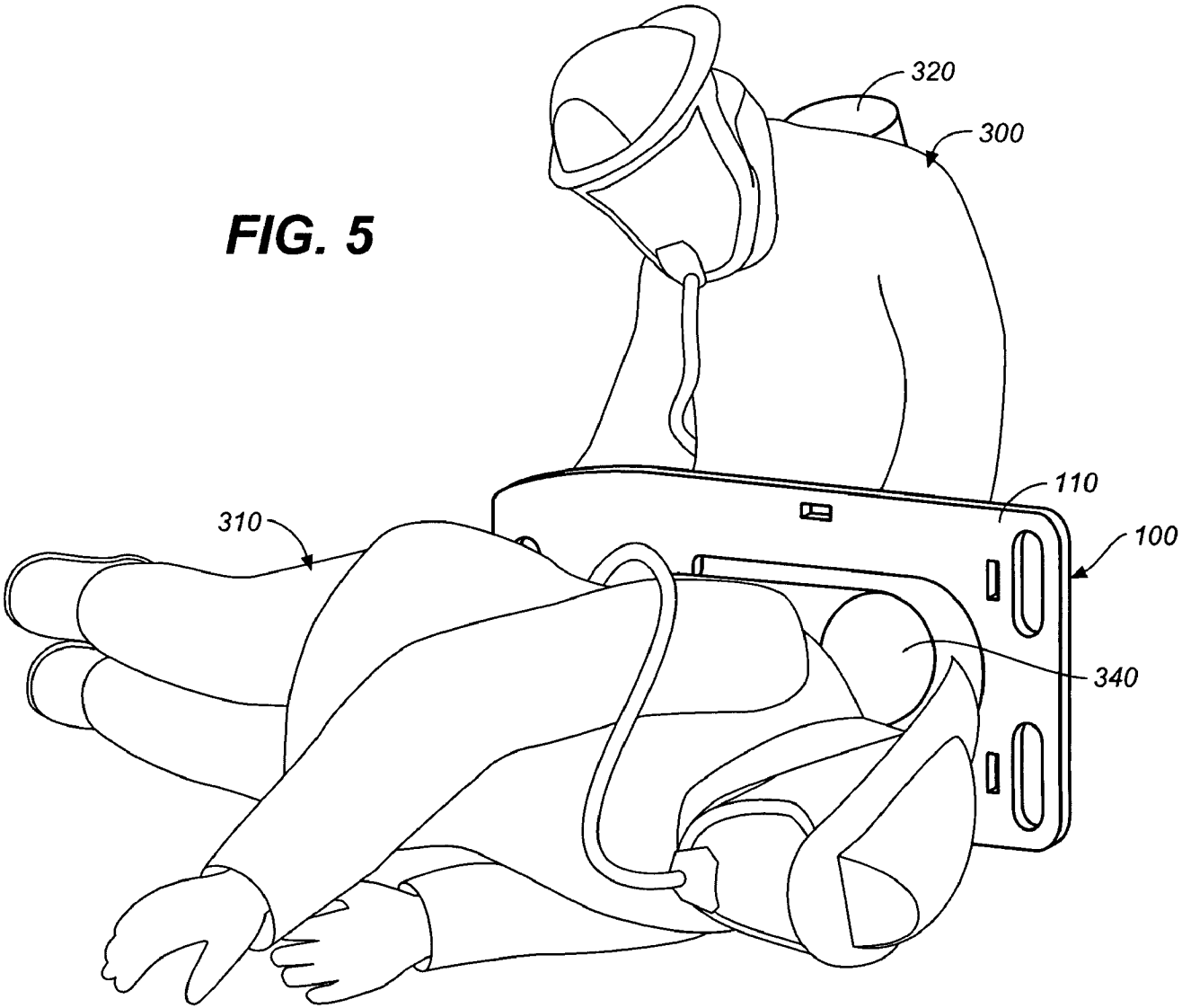
FIG. 5 is a perspective view showing one way in which the rescue board may be placed on the back of an injured victim wearing an SCBA.
Figure 6:
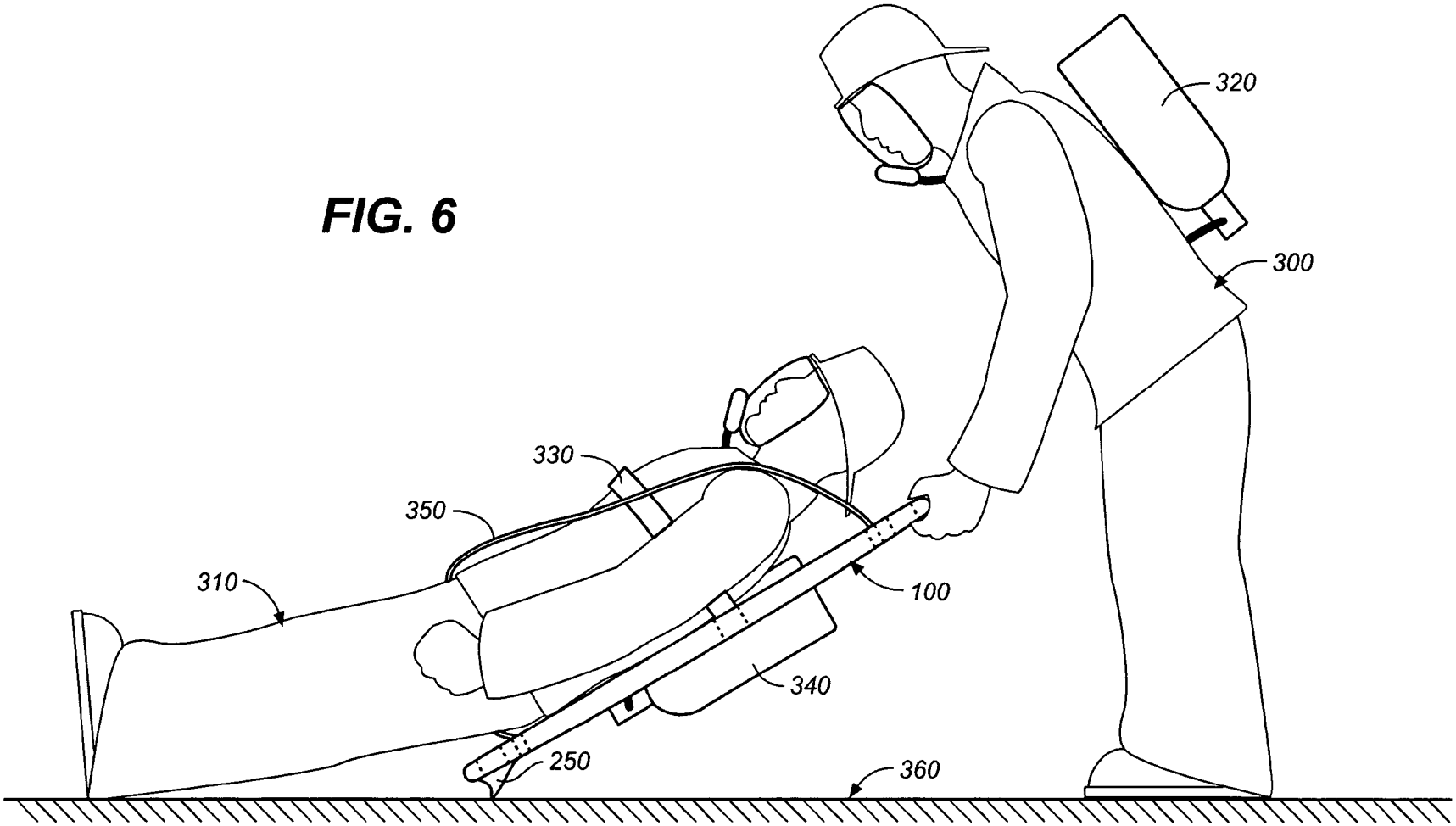
FIG. 6 is a side view in elevation showing the rescue board used to drag an injured worker who is wearing an SCBA.

FIGS. 4-6 show how the rescue board 100 may be carried by an uninjured rescue worker 300 going to the aid of a downed and non-ambulatory firefighter or hazmat worker 310. Here it is seen that the rescue board is first placed on the back of the rescuing firefighter and secured over his SCBA 320 using only the waist strap 330 of his harness system. When the downed victim is reached, the securing buckle or strap is released and the rescue board is removed. Continuing with the description of the use and rescue process, and referring now particularly to FIG. 5, the victim 310 is next rolled onto his side and the rescue board is placed over his SCBA 340. The waist strap 330 is fastened around the victim's waist, and three-point shoulder and crotch straps 350 are placed over the shoulders and under the crotch of the victim, in the manner of a conventional five-point harness. If urgency dictates and time is too short for such a procedure, the mid-body strap alone may be employed. The board is slanted up and dragged along the ground surface 360 on the tips of the drag fins 250.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A rescue board, comprising:

a generally rectangular plank having an upper deck, a lower surface, an upper/head portion, a lower/mid-body portion, a right side, a left side, and an SCBA opening extending from substantially the upper/head portion to said lower/mid/body portion and shaped and sized to be disposed around an SCBA tank and valve during a rescue operation;

wherein said SCBA opening fits around a 30-60 minute SCBA tank.

2. The rescue board of claim 1, wherein said SCBA opening is at least 5 inches in width and 18 inches in length.

3. The rescue board of claim 1, wherein said upper deck includes a concavity from said upper/head portion to said lower/mid-body portion.

4. The rescue board of claim 1, further including a harness system.

5. The rescue board of claim 4, wherein said harness system includes upper harness attachment slots disposed in said plank proximate said upper/head portion, side harness attachment slots disposed proximate each of said right and left sides, and a lower harness attachment slot disposed in said plank proximate said lower/mid-body portion, and further including straps inserted through one or more of said upper harness attachment slots, side harness attachment slots, and said lower harness attachment slot.

6. The rescue board of claim 1, further including at least one skid fin disposed on said lower surface proximate said lower/mid-body portion.

7. The rescue board of claim 1, wherein said upper body/head portion includes at least one hand hold.

8. The rescue board of claim 1, wherein said lower/mid-body portion has at least one hand hold.

9. A firefighter/hazmat worker rescue board, comprising:

a substantially rectangular plank having an upper deck, a lower surface, an upper/head portion having one or more hand holds, a lower/mid-body portion, a right side, a left side, and an SCBA opening disposed through said plank and extending from said upper/head portion to said lower/mid-body portion;

wherein said SCBA opening is shaped and sized to be readily and easily disposed around a standard-sized 30-60 minute SCBA air cylinder and valve during a rescue operation.

10. The apparatus of claim 9, wherein said SCBA opening is at least 5 in its width dimension and 18 inches in its length dimension.

11. A firefighter/hazmat worker rescue board, comprising:

a substantially rectangular plank having an upper deck, a lower surface, an upper/head portion having one or more hand holds, a lower/mid-body portion, a right side, a left side, and an SCBA opening disposed through said plank and extending from said upper/head portion to said lower/mid-body portion;

wherein said SCBA opening includes a tank portion and a valve portion.

12. The apparatus of claim 11, wherein said upper deck is concave from said upper/head portion to said lower/mid-body portion.

13. The apparatus of claim 11, wherein said upper deck is concave from said right side to said left side.

14. The apparatus of claim 11, wherein said upper deck is concave from upper/head portion to said lower/mid-body portion and from said right side to said left side.

15. The apparatus of claim 11, wherein said plank is between 0.5 and 2 inches in thickness, 15 to 25 inches in width, and 30 to 84 inches in length.

16. The apparatus of claim 11, further including a harness system, said harness system having upper harness attachment slots, side harness attachment slots, and a lower harness attachment slot, straps, and fastener and closure apparatus.

17. The apparatus of claim 11, further including at least two skid fins disposed on said lower surface.

18. The apparatus of claim 17, wherein said skid fins are removable and replaceable.

* * * * *